US006346180B1

(12) United States Patent
Gonzalez et al.

(10) Patent No.: US 6,346,180 B1
(45) Date of Patent: Feb. 12, 2002

(54) APPARATUS AND METHOD FOR MAGNETO-ELECTRODYNAMIC SEPARATION OF IONS WITHIN AN ELECTROLYTIC FLUID

(76) Inventors: Pablo Diaz-Rivera Gonzalez, Callejon de las Pilas #10, Frac. Pedregal, Cabo San Lucas (MX), 23410; Gustavo A. Solis Cortes, Nahuas #70, Frac. Coronitas, Ensenada (MX), 22860

( * ) Notice: Subject to any disclaimer, the term of this patent is extended or adjusted under 35 U.S.C. 154(b) by 0 days.

(21) Appl. No.: 09/536,065

(22) Filed: Mar. 24, 2000

(51) Int. Cl.[7] ..... B03C 1/00

(52) U.S. Cl. ..... 204/557; 204/664; 210/243; 210/748

(58) Field of Search ..... 204/557, 664, 204/554, 560; 210/243, 748, 695, 222

(56) References Cited

U.S. PATENT DOCUMENTS 5,238,547 A * 8/1993 Tsubouchi et al. ..... 204/302

* cited by examiner

*Primary Examiner*—Kathryn Gorgos
*Assistant Examiner*—Thomas H. Parsons
(74) *Attorney, Agent, or Firm*—Lyon & Lyon LLP

(57) ABSTRACT

Apparatus and method in which an electric field and a magnetic field intersect in a flow path of an electrolytic fluid, producing a flow of ions and charged particles perpendicular to both the magnetic field and the electric field. Electrolytic fluid so treated is collected for use or further processing.

26 Claims, 3 Drawing Sheets

APPARATUS AND METHOD FOR MAGNETO-ELECTRODYNAMIC SEPARATION OF IONS WITHIN AN ELECTROLYTIC FLUID

BACKGROUND OF THE INVENTION

1. Field of the Invention

The field of invention is fluid treatment, and more specifically a method and apparatus for purifying an electrolytic fluid, separating the electrolytic fluid into layers having different pH properties and concentrating ions and charged particles within those layers.

2. Description of the Related Art

An electrolytic fluid is a fluid that is electrically conductive due to the presence of dissolved ions. Examples of electrolytic fluids include salt water and battery acid. It may be desirable to remove ions or charged particles from a fluid for several different reasons. For example, removing sodium and chloride ions from salt water purifies that water. In another example, removal of ions and charged particles from industrial waste water often at least partly cleans that waste water. In another example, useful minerals may be extracted from a liquid, such as charged particles of valuable metals. Removal of charged ions and particles from a fluid can thus be used to clean a fluid or extract useful materials from it, whether used alone or as a step in a larger fluid treatment process.

Present devices and methods for removing ions and charged particles from an electrolytic fluid typically utilize consumable items, such as filters, for doing so. Replacing these consumable items is costly, time-consuming, and disruptive, as the flow of the fluid being processed may have to be halted while the consumable item is being changed. Further, disposal of used consumable items may not be environmentally friendly.

U.S. Pat. No. 5,254,234 discloses a liquid treatment apparatus directed to passing a liquid stream through a passage between two electrodes. The passage of electric current between the electrodes has beneficial effects on the liquid flowing between them, such as killing microorganisms which may be present in the liquid. However, that liquid treatment apparatus does not provide for separation of ions or charged particles from an electrolytic fluid.

SUMMARY OF THE PREFERRED EMBODIMENTS

In one aspect of a preferred embodiment, an apparatus is provided in which an electric field and a magnetic field intersect in a flow path of an electrolytic fluid, separating positive and negative ions and diverting them away from the flow direction of the electrolytic fluid.

In another aspect of a preferred embodiment, the electrolytic fluid flows through the interior of an inlet electrode before emerging into an ion separation chamber. In a further aspect of a preferred embodiment, the inlet electrode is composed of carbon or graphite, and has a hollow passage in its center through which the electrolytic fluid flows. In a further aspect of a preferred embodiment, a second electrode carries the opposite charge from the inlet electrode, creating an electric field between the inlet electrode and the second electrode. In a further aspect of a preferred embodiment, a plurality of annular magnets generates a magnetic field in the path of the electric field.

In another aspect of a preferred embodiment, a separation diaphragm may be provided between the electrodes, the diaphragm having a hole therein through which a portion of the electrolytic fluid may pass.

In another aspect of a preferred embodiment, the ion separation chamber is nonconductive and has at least one opening in its upper portion, out of which treated water can cascade to a runoff trough below. In a further aspect of a preferred embodiment, the runoff trough is nonconductive as well. In a further aspect of a preferred embodiment, treated water is also drawn from the lower portion of the ion separation chamber.

In a second preferred embodiment, one or more magnets are placed on either side of a space, and those magnets are encased in a housing substantially coextensive with the outer surfaces of those magnets. Outlets through the housing are provided adjacent the space and in both the upper and lower sections of the housing.

In a third preferred embodiment, a plurality of annular magnets are spaced apart from one another and suspended in an electrolytic fluid. Electrodes are located on the periphery of the annular magnets, preferably evenly-spaced and preferably attached to the annular magnets to form a suspension assembly. Electrolytic fluid enters the suspension assembly through the spaces between the annular magnets. The hole in the center of the lowest annular magnet is covered, as is the hole in the center of the uppermost annular magnet. An outlet hose extends from the center space within the suspension assembly to remove treated water.

DETAILED DESCRIPTION OF THE PREFERRED EMBODIMENTS

Figure 1:
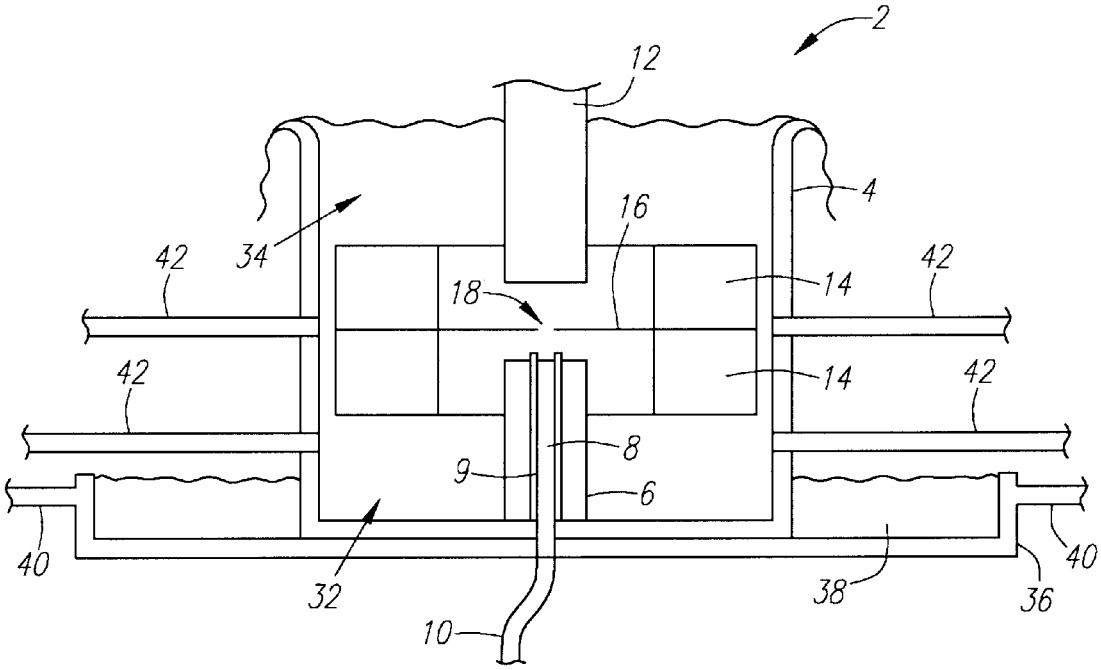
FIG. 1 is a cutaway side view of a preferred ion separation apparatus, showing the center of the magnetic field.

Referring to FIG. 1, a cutaway side view of a preferred ion separation apparatus 2 can be seen. An ion separation chamber 4 is provided, preferably in the shape of a hollow cylinder. However, the ion separation chamber 4 may take other shapes if desired; the shape of the ion separation chamber 4 is not critical to the operation of the ion separation apparatus 2. In a preferred embodiment, the ion separation chamber 4 is constructed from a nonconductive material, such as glass, ceramic or plastic, in order to prevent its interference with or disruption of electric and magnetic fields within the ion separation chamber 4.

An inlet electrode 6 extends into the ion separation chamber 4, preferably protruding substantially vertically into the ion separation chamber 4 at or near the center of the bottom surface of the ion separation chamber 4. However, other electrode orientations are within the scope of the preferred embodiment. The inlet electrode 6 is preferably secured within the ion separation chamber 4 by a structure that does not substantially interfere with the operation of the ion separation apparatus 2; such structure will be apparent to those of ordinary skill in the art. Preferably, the inlet electrode 6 is substantially cylindrical, and composed of carbon or graphite within a housing (not shown). In a preferred embodiment, the inlet electrode 6 is constructed according to U.S. Pat. No. 5,254,234, which is hereby incorporated by reference in its entirety. Of course, other configurations of inlet electrode 6 are within the scope of the preferred embodiment. A metallic conductor (not shown), such as copper wire, conductive metal tube or conductive metal wall, is preferably located within the inlet electrode 6. The metallic conductor is a better electrical conductor than the material, such as carbon, the active body of the inlet electrode 6. The presence of the metallic conductor increases the electron flow through the inlet electrode 6 to a higher level than would be present without the metallic conductor. In a preferred embodiment, the inlet electrode 6 has a hollow passage 8 through which electrolytic fluid to be treated passes. The hollow passage 8 is preferably lined with insulative material 9 to prevent erosion inside the inlet electrode 6 due to the potentially corrosive effects of the electrolytic fluid. Such insulative material 9 preferably extends from the top of the inlet electrode 6 in order to deliver the electrolyte to the best position for treatment.

Preferably, the housing protects the metallic conductor and the active body of the electrode from contact with the electrolytic fluid in the ion separation chamber 4. The inlet electrode 6 and the metallic conductor are connected to a source of direct current (not shown), such as a battery or a rectified transformer. In a preferred embodiment; the inlet electrode 6 carries a negative charge; that is, the inlet electrode 6 is a negative electrode. However, it is contemplated that the inlet electrode 6 could carry a positive charge instead and act as a positive electrode. The hollow passage 8 is connected to a tube 10 or other source of electrolytic fluid.

A second electrode 12 extends substantially vertically downward into the ion separation chamber 4, the distal end of which is located in proximity to the distal end of the inlet electrode 6. Preferably, the second electrode 12 and the inlet electrode 6 are substantially aligned with each other. The second electrode 12 is preferably substantially cylindrical, and composed of carbon or graphite within a housing (not shown). As in the inlet electrode 6, a metallic conductor (not shown), such as copper wire, a conductive metal tube or a conductive wall, is located within the second electrode 12. That metallic conductor is a better electrical conductor than the material, such as carbon or graphite, that comprises the active body of the second electrode 12. The second electrode 12 carries the opposite electric charge as the inlet electrode 6. That is, if the inlet electrode 6 is negatively charged, then the second electrode 12 is positively charged. The second electrode 12 is connected to a source of direct current or direct pulsing current (not shown). Direct pulsing current is unidirectional, like standard electric current, but has a variable voltage; a source of direct pulsing current may be rectified alternating current from a rectified transformer. In a preferred embodiment, the inlet electrode 6 and the second electrode 12 are part of a single direct-current circuit, completed via an electric field extending between the inlet electrode 6 and the second electrode 12, as will be described in greater detail below. The second electrode 12 is held in place relative to the ion separation chamber 4 by direct attachment, such as but not limited to nonconductive rods connecting the second electrode 12 to the ion separation chamber 4, or by a structure (not shown) that is not connected to the ion separation chamber 4, such as but not limited to a boom suspending the second electrode within the ion separation chamber 4. Construction of a structure for holding the second electrode 12 in place relative to the ion separation chamber 4 is within the knowledge of one of ordinary skill in the art.

While the inlet electrode 6 and the second electrode 12 have been described above as single electrodes, it is within the scope of the invention to construct the inlet electrode 6 or the second electrode 12, or both, as a plurality of electrodes. For example, the inlet electrode 6 may be constructed as a plurality of electrodes having the same electrical charge surrounding a tube utilized in lieu of the hollow passage 8 to conduct electrolytic fluid into the ion separation chamber 4. Similarly, the second electrode may be constructed as a plurality of electrodes each having the same electrical charge.

One or more magnets 14 are located within the ion separation chamber 4. The magnets 14 may be attached to the ion separation chamber by any structure that does not substantially interfere with fluid flow between the magnets 14 and the inner wall of the ion separation chamber 4. Construction of such structures is well known to those of ordinary skill in the art. In a preferred embodiment, two annular magnets 14 are connected in series and placed within the ion separation chamber 4. As is known in the art, a annular magnet has one magnetic pole on one surface and the opposite magnetic pole on the opposite surface. When two annular magnets are placed together in series with a magnetic pole of one magnet contacting the opposite magnetic pole of an adjacent magnet, they form a single magnet having a stronger magnetic field than either individual magnet alone. Of course, more than two magnets 14 may be connected in series, strengthening the magnetic field thereby generated. As shown in FIG. 1, in a preferred embodiment, two annular magnets 14 are magnetically connected in series with another, such that the upper magnet 14 has one magnetic polarity and the lower magnet 14 has an opposite magnetic polarity. The polar orientation of the magnetic field thereby generated is not critical to the invention. That is, the upper magnet 14 may act as either a north or south magnetic pole, and the lower magnet 14 then acts as the opposite magnetic pole. More than two annular magnets 14 may be used in series if a stronger magnetic field is desired. It is also within the scope of the preferred embodiment to provide a space between the magnets 14. When such a space is provided, different numbers of individual magnets 14 may be provided on each side of that space, or the individual magnets 14 on each side of that space may have different thicknesses.

While the magnet or magnets 14 have been discussed above as a plurality of annular magnets, the magnet or magnets 14 are not limited to a annular configuration. Instead, the magnet or magnets 14 may take any shape or configuration that creates a magnetic field around a central space such that the lines of magnetic force substantially prevent ions or charged particles from passing into or through that central space. For example, multipolar magnets may be used as the magnet or magnets 14, such as quadrupolar magnets, sextupolar magnets, or magnets having a greater numbers of individual components. The construction and use of such multipolar magnets is well known to those of ordinary skill in the art. As another example, parabolic or aspheric magnets may also be used as the magnet or magnets 14. Further, the magnet or magnets 14 may be placed internal to or external to the electrodes.

Preferably, the magnet or magnets 14 are electromagnets. However, the magnet or magnets 14 may be permanent magnets, if desired. The use of permanent magnets rather than electromagnets may be desirable in locations or situations where the amount, quality or reliability of electric power available to operate the ion separation apparatus 2 is low or nonexistent.

In an alternate embodiment, the magnet or magnets 14 may be located outside the ion separation chamber 4, if it has adequate strength and proper orientation to generate a magnetic field perpendicular to the electric field between the inlet electrode 6 and the second electrode 12 that still allows the ion separation apparatus to operate.

In a preferred embodiment, a plurality of annular magnets 14 are used. Preferably, a separation diaphragm 16 is located between the annular magnets 14. If more than two annular magnets 14 are used, the separation diaphragm 16 is preferably placed at or near the center of the stack of annular magnets 14, but the separation diaphragm 16 may be placed between any two of the magnets 14. If a single magnet 14 is used, the separation diaphragm 16 may be attached to that single magnet 14 using attachment strategies known in the art, such as adhesives or structural attachments such as but not limited to nonconductive screws, or protrusions from the single magnet 14 onto which the separation diaphragm 16 may be secured. The separation diaphragm 16 may be composed of any substantially chemical-resistant, nonconductive and impermeable material. The separation diaphragm 16 is preferably a substantially flat sheet. However, other configurations of the separation diaphragm 16 are contemplated; for example, the separation diaphragm 16 may be convex, concave, or conical, or another shape that does not interfere with the migration of charged ions and particles as disclosed below. In a preferred embodiment, the separation diaphragm 16 has a hole 18 substantially aligned with the exit of the hollow passage 8 from the inlet electrode 6. The hole 18 is preferably substantially circular, but may take other shapes if desired.

As discussed above, in a preferred embodiment, the electrolytic fluid to be treated is introduced into the ion separation apparatus 2 through a tube 10 or other apparatus capable of carrying the fluid. The tube 10 is preferably connected to the hollow passage 8 in the inlet electrode 6, such that the electrolytic fluid passes through the interior of the inlet electrode 6.

Figure 2:
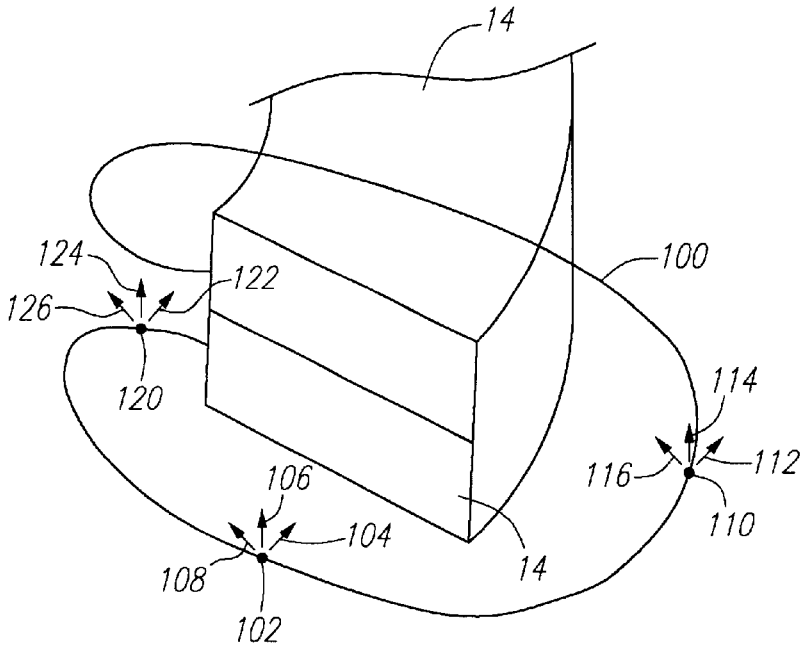
FIG. 2 is a cutaway perspective view of the magnets of a preferred embodiment, schematically showing a single magnetic flux line.

Turning to FIG. 2, a schematic representation of a magnetic field and of an electric field within the ion separation chamber 4 can be seen. A two-dimensional slice of the three-dimensional magnetic field can be seen. In a preferred embodiment in which annular magnets 14 are used, the magnetic field is substantially identical at each diameter of the annular magnets 14. That is, the magnetic field is preferably both bilaterally and radially symmetrical.

Electrolytic fluid is preferably introduced into the ion separation chamber through the hollow passage 8 in the inlet electrode 6, forming a stream that tends to widen in a substantially symmetrical manner as the distance from the inlet electrode 6 increases. In a preferred embodiment, because the inlet electrode 6 is oriented substantially vertically, the stream of electrolytic fluid exiting the hollow passage 8 is directed substantially vertically upward through fluid already present in the ion separation chamber 4. Gravitational force acts equally downward on all components of the stream of electrolytic fluid exiting the hollow passage 8; thus, the substantial radial symmetry of the stream exiting the hollow passage 8 is maintained. In a preferred embodiment, electrolytic fluid travels through the hollow passage 8 into the ion separation chamber 4 at a substantially constant flow rate.

As the electrolytic fluid exits the hollow passage 8, ions and charged particles in the electrolytic fluid are subjected to mechanical forces exerted by the interaction of the magnetic field and the electric field. In a preferred embodiment, the inlet electrode 6 has a negative charge and the second electrode 12 has a positive charge. An electric current is thus established in the electrolytic fluid exiting from the hollow passage 8. That current travels through the least resistive path, which in a substantially homogeneous fluid medium is substantially the shortest path between the inlet electrode 6 and the second electrode 12. The electric field is thus created. The electric field exerts a force on charged ions and particles within the electrolytic fluid. In the absence of the magnetic field, negatively-charged ions and particles exiting the hollow passage 8 would be carried along with that flow of electric current in the electric field, being attracted to the positively-charged second electrode 12. Further, in the absence of the magnetic field, positively-charged ions and particles exiting the hollow passage 8 are instead attracted in the direction of the inlet electrode 6, being attracted to the negatively-charged inlet electrode 6. The electric field also serves to dissociate chemical compounds dissolved within or present in the electrolytic fluid into ions and to impart a charge to particles located within the electrolytic fluid, such that the ions and particles thereby charged can be separated from the electrolytic fluid along with the ions already present within the electrolytic fluid. That is, a number of molecules present in the electrolytic fluid that have not already dissociated into ions are ionized by the electric field when they emerge from the inlet electrode 6 into the electric field.

In a preferred embodiment, the voltage used to generate the electric field varies depending on the concentration of electrolytes within the electrolytic fluid. As the concentration of electrolyte within the electrolytic fluid increases, the voltage required to establish an electric current between the inlet electrode 6 and the second electrode 12 decreases. This relationship between electrolyte concentration and conductivity of the fluid is known to those of ordinary skill in the art. Table 1 shows experimentally-determined values for this relationship, where the concentration is the concentration of sodium chloride in water.

TABLE 1

| Concentration (ppm) | 1000 | 10,000 | 20,000 |
|---|---|---|---|
| Voltage (VDC) | 50 | 20 | 12 |

Higher voltages than those shown in Table 1 may be utilized, if desired. As the voltage applied to the electrolytic fluid increases, bubbles begin to form near the second electrode 12. However, the bubbles tend to disrupt the flow of current between the inlet electrode 6 and the second electrode 12, and thus disrupt the electric field. As the number of bubbles increases, a point is reached where almost no electric current can flow between the inlet electrode 6 and the second electrode 12. Thus, bubble formation places a practical limit on the voltage that can be applied across the inlet electrode 6 and the second electrode 12. This voltage limit depends on the concentration and nature of the electrolyte in the electrolytic fluid.

Charged particles are not attracted to or repulsed by magnetic poles. However, it is well known in the art that a moving electrically-charged particle will be deflected laterally by a magnetic field. The Hall effect is an example of such a deflection. A corollary that is also known in the art is that a magnetic field does not exert force on a charged particle moving parallel to it. Rather, the force exerted by a magnetic field on a charged particle moving through that magnetic field is perpendicular to the charged particle's velocity component perpendicular to the magnetic field. Thus, the strength and the direction of the force exerted by the magnetic field on a charged particle passing through it depends on the direction of travel of the charged particle through the magnetic field, as well as the strength and orientation of the magnetic field and the magnitude of the charge carried by the charged particle. Perpendicularity to the magnetic field at any given point is defined as a direction perpendicular to the magnetic flux line at that point. It will be appreciated that more than one direction will be considered perpendicular to the magnetic field at any given point.

To illustrate the effect of the combined electric field and magnetic field, a particular magnetic flux line 100 generated by the magnet 14 is shown in FIG. 2. It will be seen that a charged particle can encounter a magnetic flux line from the magnet 14 in a perpendicular direction in two separate dimensions. An individual magnetic flux line 100 is shown, with a particular region 102 of that magnetic flux line 100 identified for purposes of discussion. The region 102 is underneath the magnet 14. At the region 102 of the magnetic flux line 100, a charged particle moving in a first direction 104, arbitrarily identified as the x-direction for the purpose of this discussion, moves perpendicular to the magnetic flux line 100; the magnetic field exerts a force on that charged particle perpendicular to its direction of travel. At the region 102, a charged particle moving in a second direction 106, the z-direction, also moves perpendicular to the magnetic flux line 100, so the magnetic field exerts a force on that charged particle perpendicular to its direction of travel. At the region 102, a charged particle moving in a third direction 108, the y-direction, moves parallel to the magnetic flux line 100, so the magnetic field does not exert a force on that charged particle.

Still referring to FIG. 2, a second region 110 of the magnetic flux line is shown. The second region 110 is located near the outer edge of the magnet 14. As with the region 102, a charged particle moving in a first direction 112, the x-direction, moves perpendicular to the magnetic flux line 100, so the magnetic field exerts a force on that charged particle perpendicular to its direction of travel. However, a charged particle moving in a second direction 114 at the second region 110, the z-direction, moves parallel to the magnetic flux line 100, so the magnetic field does not exert a force on that charged particle. In addition, a charged particle moving in a third direction 116 at the second region 110, the y-direction, moves perpendicular to the magnetic flux line 100, so the magnetic field exerts a force on that charged particle perpendicular to its direction of travel. Thus, at the second region 110 at the outer edge of the magnet 14, the magnetic field is oriented in such a fashion that charged particles are encouraged to migrate upward with minimal interference from the magnetic field.

Still referring to FIG. 2, a third region 120 of the magnetic flux line 100 is shown. The third region 120 is located in the central space of the annular magnet 14 of the preferred embodiment. As with the region 102 and the second region 110, a charged particle moving in a first direction 122, the x-direction, moves perpendicular to the magnetic flux line 100 at the third region 120, so the magnetic field exerts a force on that charged particle perpendicular to its direction of travel. At the third region 120, a charged particle moving in a second direction 124, the z-direction, also moves perpendicular to the magnetic flux line 100, so the magnetic field exerts a force on that charged particle perpendicular to its direction of travel. However, at the third region 120, a charged particle moving in a third direction 126, the y-direction, moves substantially parallel to the magnetic flux line 100, so the magnetic field does not exert a force on this particle.

It will be seen from the previous description that the preferred embodiment produces a flow of ions and charged particles perpendicular to both the magnetic field and the electric field. The interaction between charged particles such as ions and the magnetic field tend to push the charged particles away from the magnet 14 and toward the outer edge of the magnet 14. The configuration of magnetic flux lines in the center of the annular magnet tends to push charged particles downward away from the hole 18. Thus, charged particles that migrate from the space beneath the magnet 14 to the space above the magnet generally do so around the outer edge of the magnet 14. Of course, it will be understood that a number of charged ions particles will migrate upward through the center of the magnet 14, where lines tangent to the magnetic flux lines are substantially vertical. However, for ions moving at low speed, transit through the hole 18 is unstable, so most of the ions at the center are pushed away as described above.

It can be seen that the forces exerted by the magnetic field tend to repel particles having either a negative or positive charge from the central space within the magnet; the electric field tends to ionize molecules as they enter the ion separation chamber 4 and works to separate positively-charged particles from negatively-charged particles. Referring back to FIG. 1, the electric field in a preferred embodiment is oriented such that the inlet electrode 6 carries a negative charge and the second electrode 12 carries a positive charge. The second electrode 12 thus tends to attract negatively-charged ions and particles upward, and the inlet electrode 6 tends to attract positively-charged particles downward. The negative ions attracted upward tend to travel around the outer edge of the magnet 14, and tend to remain above the magnet 14 once they reach that area. Further, the positive ions tend to be attracted to the inlet electrode 6, and tend to remain below the magnet 14.

The electric field thus serves two major functions. First, it ionizes a portion of the molecules exiting the hollow passage 8, improving the ability of the ion separation apparatus 2 to purify the water within the ion separation chamber 4. Second, the electric field serves to separate the negatively-charged particles into an upper layer 34 within the ion separation chamber 4 and the positively-charged particles into a lower layer 32.

Thus, the fluid within the ion separation chamber 4 stratifies into two substantially separate and discrete layers. In the preferred embodiment, wherein the inlet electrode 6 is negatively charged, the lower layer 32 tends to have a lower pH than the upper layer 34. The pH of a liquid is a function of the amount of hydrogen ion $H^+$ present in that liquid. When the electrolytic fluid is aqueous, the presence of an electric current in that aqueous fluid will dissociate a certain number of water molecules into hydrogen ions $H^+$ and hydroxyl ions $OH^-$. Thus, the concentration of hydrogen ions $H^+$ in the lower layer 32 in the ion separation chamber will be greater than the concentration of hydrogen ions $H^+$ in the upper layer 34, resulting in the lower layer 32 being more acidic than the upper layer 34. If the electrolytic fluid is not aqueous, the hydrogen ions $H^+$ present in the electrolytic fluid will likewise migrate to the inlet electrode 6, also resulting in the lower layer 32 being more acidic than the upper layer 34.

The flow rate of the electrolytic fluid into the ion separation chamber 4 is selected to be below the flow rate at which the momentum of the fluid would carry a large enough number of charged ions and particles through the hole 18 to negatively affect the composition of the treated water. This flow rate will vary depending on the strength of the magnetic field and the strength of the electric field, as well as the capacity of the ion separation chamber 4. In one example, the flow rate is substantially one gallon per minute and the ion separation chamber 4 has a capacity of substantially 0.2 gallons. Some of the treated fluid passes through the hole 18, and the remainder impacts the separation diaphragm and is deflected downward. The separation diaphragm 16 and the hole 18 thus have an additional effect of reducing the force of the upward current caused by fluid exiting the inlet electrode 6, and thereby promoting desirable stratification of the fluid within the ion separation chamber 4.

It will be appreciated that the motion of the charged ions and particles, as well as the separation of the negative ions 24 from the positive ions 28, results from the combined interaction of the magnetic field and the electric field, and not from any reaction between the ions or charged particles and the surface of the inlet electrode 6, the second electrode 12 or the magnet or magnets 14. Reactions between the charged ions or particles and the inlet electrode 6, the second electrode 12 or the magnet or magnets 14 are undesirable, as such reactions would necessitate periodic replacement of components as they were attacked or eroded away by charged ions or particles within the electrolytic fluid.

Due to electrically-neutral particulates in the electrolytic fluid, or chemical reactions in the upper layer 34, electrically-neutral precipitate can form in the upper layer 34. The separation diaphragm 16 reduces the amount of such precipitate that falls into the lower layer 32 from the upper layer 34 by catching precipitate on its upper surface.

As discussed above, bubbles tend to form near the second electrode 12 as the voltage applied between the inlet electrode 6 and the second electrode 12 increases. These bubbles tend to carry positive and negative ions both out of the fluid to the upper surface, due in part to the strength of the buoyancy force of the bubble and to the surface tension of the bubble walls. To the extent that the ions within a bubble are in a gaseous state and are released to the atmosphere or surrounding gas when the bubble bursts on the fluid surface, the presence of bubbles is beneficial and assists in removing ions and particles from the electrolytic fluid.

Referring back to FIG. 1, the ion separation chamber 4 preferably has an outlet at or near its top, allowing the fluid in the upper layer 34 to spill out of the ion separation chamber 4 and allowing bubbles to escape from the ion separation chamber 4. In a preferred embodiment, a runoff trough 36 is connected to the outer surface of the ion separation chamber 4 to catch the fluid spilling out of the ion separation chamber 4. Of course, other means may be used to allow the fluid from the upper layer 34 to be removed into the runoff trough 36. For example, the top of the ion separation chamber 4 may be closed, and a conduit or hole may be provided in the upper portion of the ion separation chamber 4. The upper portion of the ion separation chamber 4 is defined as the vertical distance from the top of the ion separation chamber 4 that corresponds to the depth of the upper layer 34. Preferably, the ion separation chamber 4 is substantially cylindrical, and the runoff trough 36 is a sturdy liner which may be annular or another shape. A runoff fluid 38 collects within the runoff trough 36, being composed of the spillover fluid from the upper layer 34 within the ion separation chamber 4. One or more runoff fluid collection tubes 40 may extend from the runoff trough 36 to carry the runoff fluid 38 to a separate location for use, storage or disposal.

In a preferred embodiment, one or more chamber collection tubes 42 extend out of the lower portion of ion separation chamber 4. The lower portion of the ion separation chamber 4 is defined as the vertical distance from the bottom of the ion separation chamber 4 corresponding to the depth of the lower layer 32. The depth of the lower layer 32 and the depth of the upper layer 34 will vary depending on the contents of the electrolytic fluid and the strength of the electric field and the magnetic field. The chamber collection tube or tubes 42 collect fluid from the lower layer 32 within the ion separation chamber 4, and carry that fluid from the lower layer 32 to a separate location for use, storage or disposal. The chamber collection tube or tubes 42 are thus connected to the ion separation chamber 4 at a height allowing the chamber collection tube or tubes 42 to collect fluid from the lower layer 32. It has been experimentally determined that when seawater is treated in the ion separation apparatus 2, the water in the upper layer 34 is murkier and contains more suspended solids than the water in the lower layer 32. Thus, where seawater is treated, the chamber collection tube or tubes 42 typically carry the cleaner water in the lower layer 32 to a location for use or for further purification. As an example, it has been experimentally determined that when electrolytic fluid is introduced into the ion separation chamber 4 at a flow rate of 1.0 gallons per minute, the ion separation apparatus 2 operates to produce a flow rate from the lower layer 32 through the chamber collection tube or tubes 42 of 0.8 gallons per minute and a flow rate from the upper layer 34 to the runoff trough 36 of 0.2 gallons per minute.

While the ion separation apparatus 2 has been described in terms of a given polarity of the inlet electrode 6 and the second electrode 12, it is within the scope of the invention to reverse the polarity of the ion separation apparatus 2. That is, the ion separation apparatus may be constructed such that the inlet electrode 6 is positively charged and the second electrode 12 is negatively charged. Of course, in such a configuration the migration of positively-charged and negatively-charged ions and particles is reversed, as is the relative pH of the fluid in the lower layer 32 and the upper layer 34. In addition, references to a magnet 14 should be read to encompass a plurality of magnets connected in series, as appropriate to the context, because magnets connected in series collectively take on the attributes of a single magnet.

Figure 3:
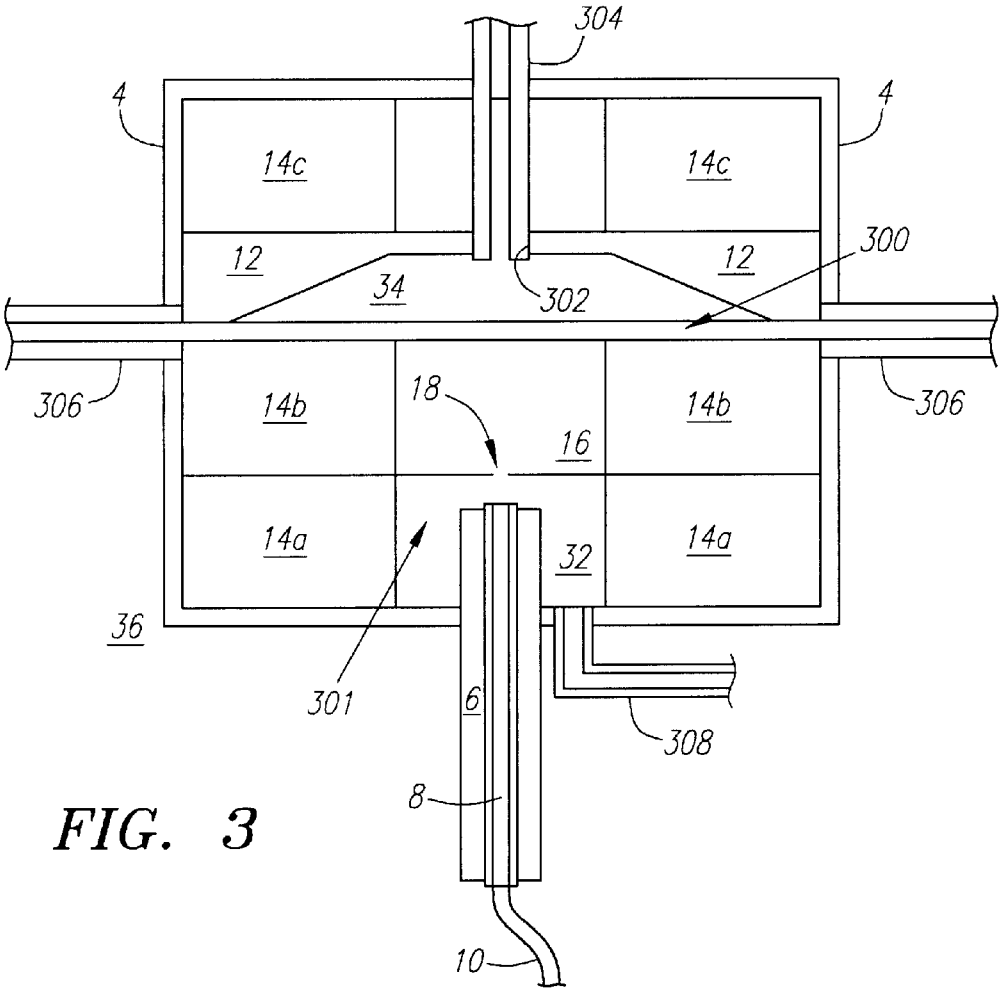
FIG. 3 is a cutaway side view of a second preferred ion separation apparatus.

Referring to FIG. 3, a second preferred embodiment is seen. In this second preferred embodiment, the ion separation chamber 4 is substantially coextensive with the outer surfaces of the magnets 14, such that little or no electrolytic fluid travels between the outer surfaces of the magnets 14 and the walls of the ion separation chamber 4. Seals or gaskets which are durable and chemically resistant may be provided to minimize or eliminate flow between the magnets 14 and the walls of the ion separation chamber 4. In this embodiment, the ion separation chamber 4 is preferably composed of polyvinyl chloride material.

In the second preferred embodiment, a space 300 is provided between one or more magnets 14 provided on either side of that space. Advantageously, two or more magnets 14*a*, 14*b* are located under the space 300, and a single magnet 14*c* is located above the space 300. The two or more lower magnets 14 are preferably connected in series with one another. It is within the scope of the preferred embodiment that a magnet 14 is provided under the space 300 which is thicker than the magnet 14 provided over the space 300. Annular magnets 14 are preferably used, such that a cavity 301 is formed at the center of the ion separation chamber 4. Magnets having other configurations may instead be utilized, such as but not limited to multipolar magnets. As in the preferred embodiment, a separation diaphragm 16 having an opening 18 substantially aligned with the exit of the hollow passage 8 is provided, and serves the same function as in the preferred embodiment. Preferably, the separation diaphragm 16 is located between the lower magnets 14*a*, 14*b*.

The inlet electrode 6 is as described above in the preferred embodiment. Preferably, the inlet electrode 6 extends into the cavity 301 a distance less than half the thickness of the magnet or magnets 14 located under the space 300. This distance may be varied if desired. Preferably, the second electrode 12 is configured differently from the preferred embodiment. The second electrode 12 is preferably shaped to match the configuration of the magnets 14, and has an opening 302 substantially at its center. Where annular magnets 14 are used, the second electrode 12 is substantially circular when viewed from the top. The opening 302 is preferably adapted to receive an waste line 304 opening to the center of the space 300. The waste line 304 is preferably aligned with the hollow passage 8 in the inlet electrode 6. The waste line 304 is not required for the ion separation apparatus 2 to function. The second electrode 12 preferably slopes downward over at least a portion of the distance between the opening 302 and the wall of the ion separation chamber 4 in order to facilitate flow of the electrolytic fluid. However, the second electrode 12 may be flat, or may have another cross-section entirely, as long as the functionality of the ion separation apparatus is maintained. In a preferred embodiment, the inlet electrode 6 carries a positive charge and the second electrode 12 carries a negative charge.

One or more upper outlet tubes 306 are connected to the ion separation chamber 4 such that the upper outlet tubes 306 open to the edge of the space 300. One or more lower outlet tubes 308 are connected to the ion separation chamber 4 such that the lower outlet tube 308 opens to the space at the center of the lowermost magnet 14.

The ion separation apparatus of the second preferred embodiment operates on the same principles disclosed above. As above, electrolytic fluid containing ions and charged particles is discharged from the hollow passage 8 in the inlet electrode 6 into the ion separation chamber 4. Preferably, the flow rate through the hollow passage 8 is substantially constant.

Preferably, the inlet electrode 6 is positively charged and the second electrode 12 is negatively charged. An electric current is established in the electrolytic fluid within the ion separation chamber 4, resulting in an electric field between the inlet electrode 6 and the second electrode 12, as described above. In the absence of the magnetic field generated by the magnets 14, positively-charged ions and particles exiting the hollow passage would be attracted to the negatively-charged second electrode 12 and follow a substantially straight path to it; conversely, negatively-charged ions and particles would follow a substantially straight path to the positively-charged inlet electrode 6.

Figure 4:
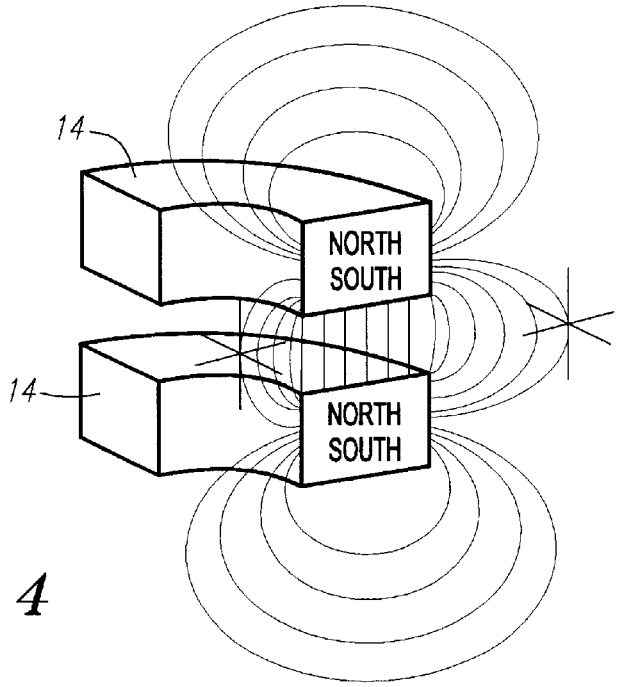
FIG. 4 is a cutaway perspective view of the magnets of the embodiment of FIG. 3, schematically showing magnetic flux lines.

As in the preferred embodiment, the motion of a charged ion or particle in a perpendicular direction through a magnetic field results in a force acting perpendicular to the direction of motion of the charged ion or particle. Referring also to FIG. 4, a schematic representation of the magnetic field generated by the magnets 14 is shown. The discussion above regarding the motion of a charged ion or particle through a magnetic field applies equally here. The magnets 14 are oriented such that the polarity of the upper surface of the lower magnet 14 is the opposite of the polarity of the lower surface of the upper magnet 14. As a charged ion or particle passes through the magnetic flux lines in the center of the magnets 14, lateral forces are exerted on that charged ion or particle that tend to drive that charged ion or particle away from the center space of the magnets 14. Those charged particles having an opposite charge from the second electrode 12 are also attracted upward. The combination of the outward force generated by the motion of the charged ion or particle through the magnetic field and the upward force exerted by the second electrode 12 results in charged ions and particles entering the space 300, eventually moving between the upper magnet 14*c* and the lower magnet 14*b*. Directly between the upper magnet 14*c* and the lower magnet 14*b*, the lines of magnetic force are substantially straight. Thus, as a charged ion or particle moves radially toward the upper outlet tubes 306, its motion is substantially perpendicular to those lines of force, causing the charged ion or particle to deflect laterally. The new direction of motion of the charged ion or particle is itself substantially perpendicular to the magnetic lines of force, resulting in another lateral deflection. It will be appreciated that a charged particle or ion will eventually reach the wall of the ion separation chamber 4 or an upper outlet tube 306 as a result of the lateral forces acting on it during its motion directly between the magnets 14. The preferred shape of the second electrode 12, extending laterally coextensive with the magnets 14, acts to attract ions and charged particles upward, while providing little or no lateral attractive force. The use of an electrode according to the preferred embodiment would tend to attract particles to the center of the ion separation chamber 4 in this second preferred embodiment, making it less desirable for use in this second preferred embodiment.

The portion of the electrolytic fluid which is not charged or ionized is not affected by passage through the electric and magnetic fields in the ion separation chamber 4. Instead, this fluid moves upward in the ion separation chamber 4 and is collected by the waste line 304. The fluid collected by the waste line 304 has substantially the same composition as the fluid initially introduced into the ion separation chamber 4, so it may be returned to the source of the fluid introduced into the ion separation chamber 4, if desired.

If the inlet electrode 6 carries a positive charge, which is preferred, negatively-charged ions such as $OH^-$ are attracted to it, and the fluid which collects near the lower outlet tube 308 has a lower pH than the fluid in the space 300. If the inlet electrode 6 carries a negative charge, positively-charged ions such as $H^+$ are attracted to it, and the fluid which collects near the lower outlet tube has a higher pH than the fluid in the space 300.

Figure 5:
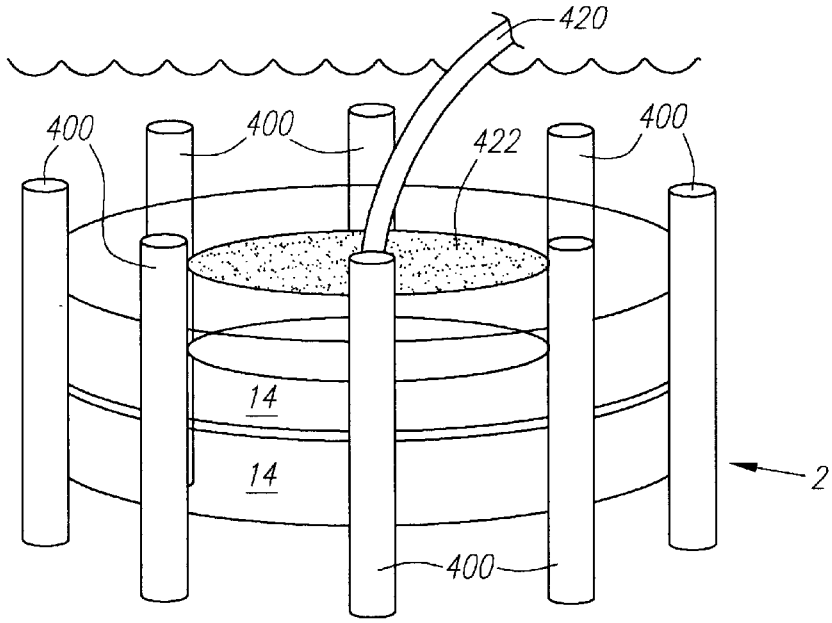
FIG. 5 is a perspective view of a third preferred ion separation apparatus.
Figure 6:
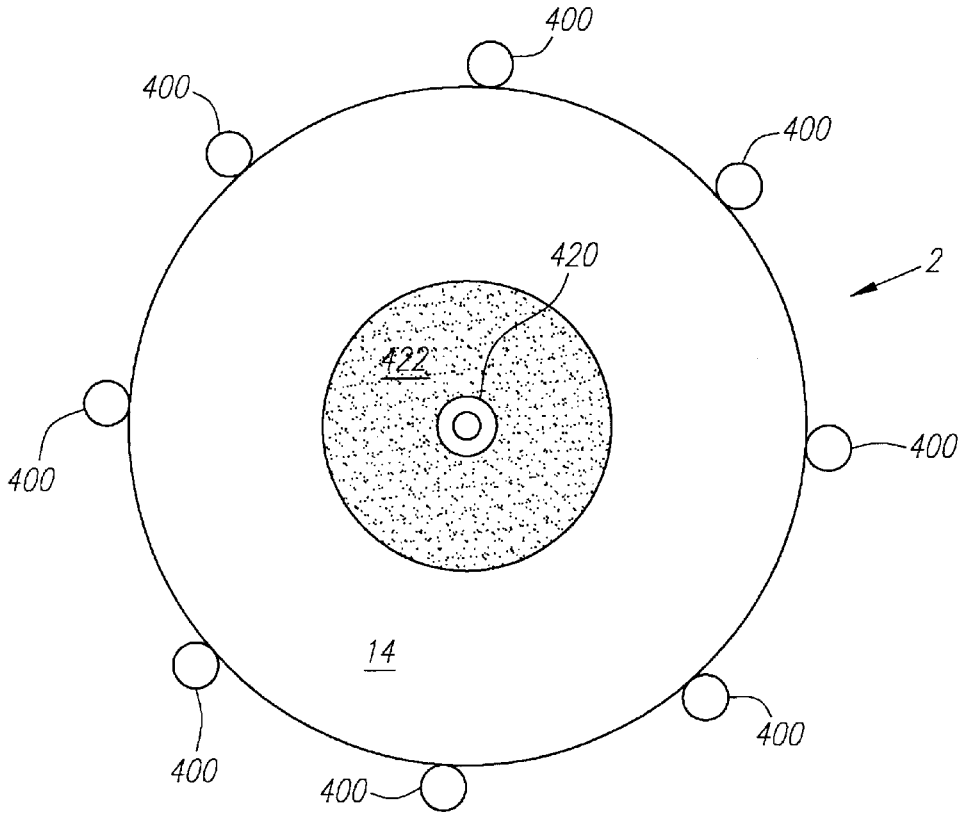
FIG. 6 is a top view of the ion separation apparatus of FIG. 4.

A third preferred embodiment of the ion separation apparatus 2 is shown in FIGS. 5 and 6. A plurality of annular magnets 14 are connected in series and spaced apart, to allow electrolytic fluid to enter the space or spaces between them. A number of magnets 14 may be connected to form a tower, if desired. The inlet electrode 6 and the second electrode 12 are not present. Instead, a plurality of electrodes 400 are spaced around the magnets 14. The electrodes 400 are oriented substantially perpendicular to the magnets 14, and are preferably oriented substantially vertically. Preferably, the electrodes 400 are spaced substantially evenly around the annular magnets 14. In a preferred embodiment, eight electrodes 400 are used, spaced forty-five degrees from each other along the outer rim of the magnets 14. Other numbers of magnets may be used if desired, and are correspondingly spaced substantially evenly around the perimeter of the magnets 14. The electrodes 400 may be adapted to structurally hold the magnets 14 together within the assembly, or a nonconductive frame or other structure known to one of ordinary skill in the art may be used to interconnect the magnets 14 and the electrodes 400.

The ion separation apparatus 2 is adapted to be placed in a quantity of electrolytic fluid without the need for an ion separation chamber 4. The ion separation apparatus 2 may be placed in the electrolytic fluid by a variety of means, such as suspension from above. There is no requirement to hold the ion separation apparatus 2 in one specific location in the electrolytic fluid; drifting or other motion of the immersion assembly is acceptable so long as the ion separation apparatus 2 is not allowed to drift away or become lost.

An output hose 420 is connected to the ion separation apparatus 2 such that the inlet of the output hose is substantially at the center of the magnets 14. The output hose 420 is preferably flexible, and impermeable to the electrolytic fluid. The output hose 420 may be constructed and attached to the ion separation apparatus 2 so as to suspend the ion separation apparatus 2 from above, eliminating the need to provide separate structure or mechanisms for suspending the ion separation apparatus 2. The output hose 420 actively pulls fluid from the center of the ion separation apparatus 2, using means known in the art such as but not limited to a pump or a siphon. Preferably, the output hose 420 draws treated fluid from the center of the ion separation apparatus 2 at a substantially constant flow rate. The output hose 420 includes an upper seal 422 that closes off the center opening in the uppermost magnet 14 to the surrounding electrolytic fluid. A lower seal (not shown) blocks the central opening in the lowermost magnet 14. Therefore, as the output hose 420 pulls fluid from the center of the ion separation apparatus 2 electrolytic fluid is drawn into the space between the magnets 14.

The electrodes 400 perform two functions. First, they serve to dissociate molecules present in the electrolytic fluid into ions, and to charge particles floating in the electrolytic fluid. Second, the electrodes 400 exert a force on charged ions and particles, attracting or repelling them depending on their electrical charge. Preferably, the electrodes 400 are substantially rod-shaped and are oriented substantially vertically. In a preferred embodiment, there are an even number of electrodes 400 having a polarity which alternates from one electrode 400 to the next electrode 400. That is, if one electrode 400 has a positive charge at its upper end and a negative charge at its lower end, then the adjacent electrodes 400 each have a negative charge at the upper end and a positive charge at the lower end. Preferably, the electrodes 400 are partly insulated, such that the portion of each electrode 400 facing away from the magnets 14 is electrically active, and the rest of each electrode 400 is electrically insulated.

Electrolytic fluid carrying ions and charged particles is drawn toward the ion separation apparatus 2 to replace the fluid drawn out through the output hose 420. As in the other preferred embodiments, the motion of a charged ion or particle in a perpendicular direction through a magnetic field results in a force acting perpendicular to the direction of motion of the charged ion or particle. That is, as charged ions or particles approach the ion separation apparatus 2, the polarities of the individual electrodes 400 exert forces on those charged ions or particles that cause them to move relative to the magnetic field, as described above. These forces push both positively-charged and negatively-charged ions and charged particles away from the ion separation apparatus, diverting them from the spaces between the magnets 14. Thus, the liquid pulled through the output hose 420 contains few or no ions or charged particles. Preferably, the third embodiment is utilized in larger volumes of electrolytic fluid and is not fixed in one location in the fluid, as stationary use of this ion separation apparatus 2 tends to concentrate ions and charged particles nearby, resulting in a greater number of ions and charged particles entering the ion separation apparatus and the output tube 420.

While this embodiment has been described in terms of the use of annular magnets, it will be apparent to one of ordinary skill in the art that magnets having other shapes may be used, and that multipolar magnets would be suitable for use in the immersion assembly.

A preferred method and apparatus for electromagnetic separation of charged ions and particles within an electrolytic fluid, and many of their attendant advantages, have thus been disclosed. It will be apparent, however, that various changes may be made in the content and arrangement of the steps or in the form and parts of the apparatus without departing from the spirit and scope of the invention, the method and apparatus hereinbefore described being merely preferred or exemplary embodiments thereof. Therefore, the invention is not to be restricted or limited except in accordance with the following claims and their legal equivalents.

What is claimed is:

1. An apparatus for separating charged ions and particles from an electrolytic fluid, comprising:

a substantially nonconductive ion separation chamber;

an inlet electrode extending into said ion separation chamber, said inlet electrode carrying an electric charge and having a hollow passage through which the electrolytic fluid enters said ion separation chamber;

a second electrode extending into said ion separation chamber, said second electrode carrying an electric charge opposite to the charge carried by the inlet electrode;

a magnet oriented to produce a magnetic field between the inlet electrode and the second electrode, said magnet exerting force on charged ions or particles in the electrolytic fluid as they move through said magnetic field; and a separation diaphragm attached to said magnet, said separation diaphragm being substantially nonconductive and impermeable, and having a hole substantially in line with the flow of electrolytic fluid from said inlet electrode.

2. The apparatus of claim 1, further comprising at least one additional magnet connected in series with said magnet.

3. The apparatus of claim 1, further comprising at least one additional magnet spaced apart from said magnet.

4. The apparatus of claim 1, wherein said magnet is annular.

5. The apparatus of claim 1, said inlet electrode further comprising insulative material lining said hollow passage and protruding outside said inlet electrode into said ion separation chamber.

6. The apparatus of claim 1, wherein said inlet electrode extends upward into said ion separation chamber and said second electrode extends downward into said ion separation chamber.

7. The apparatus of claim 6, wherein said inlet electrode and said second electrode are oriented substantially vertically and are substantially aligned with one another.

8. The apparatus of claim 1, wherein said inlet electrode carries a negative charge and said second electrode carries a positive charge.

9. The apparatus of claim 1, wherein said ion separation chamber has at least one opening in an upper portion through which fluid can escape.

10. The apparatus of claim 1, further comprising at least one chamber collection tube extending from said ion separation chamber through which fluid from a lower portion of said ion separation chamber can be removed.

11. An apparatus for separating charged ions and particles from an electrolytic fluid, comprising:

a substantially nonconductive ion separation chamber having at least one opening in its upper portion;

a negatively-charged inlet electrode extending substantially vertically upward into said ion separation chamber, said inlet electrode comprising a hollow passage through which the electrolytic fluid enters said ion separation chamber and a conductive material protected from contact with the electrolytic fluid;

a positively-charged second electrode extending substantially vertically downward into said ion separation chamber in substantial alignment with said inlet electrode, such that an electric field is established between said inlet electrode and said second electrode;

a plurality of annular electromagnets connected in series to produce a magnetic field between the inlet electrode and the second electrode;

a separation diaphragm between two of said magnets, said separation diaphragm having a hole substantially in line with the flow of electrolytic fluid from said inlet electrode; and a chamber collection tube connected to said ion separation chamber through which treated fluid can be removed from said ion separation chamber.

12. A method for separating charged ions and particles from an electrolytic fluid, comprising the steps of:

generating an electric field between electrodes;

generating a magnetic field between said electrodes;

directing a stream of electrolytic fluid into the space between said electrodes, wherein the charged ions and particles of said electrolytic fluid are deflected from said stream of electrolytic fluid by the force exerted by the magnetic field; and placing a substantially nonconductive and impermeable separation diaphragm between said electrodes, said separation diaphragm having a hole in the path of said stream of electrolytic fluid.

13. The method of claim 12, wherein said generating an electric field step utilizes an inlet electrode and a second electrode having opposing charges to generate said electric field, further comprising the step of passing the electrolytic fluid through said inlet electrode.

14. The method of claim 12, wherein said generating a magnetic field step utilizes at least one annular magnet placed adjacent said inlet electrode and said second electrode.

15. The method of claim 12, further comprising the step of providing a chamber into which said stream of electrolytic fluid is directed.

16. The method of claim 15, further comprising the step of allowing fluid to escape from an upper portion of said chamber.

17. The method of claim 15, further comprising the step of collecting fluid from a lower portion of said chamber.

18. A method for separating charged ions and particles from an electrolytic fluid, comprising the steps of:

generating an electric field between a charged inlet electrode and an oppositely-charged second electrode;

generating a magnetic field between said inlet electrode and said second electrode;

directing a stream of electrolytic fluid through a passage in said inlet electrode into the space between said inlet electrode and said second electrode;

placing a substantially nonconductive and impermeable separation diaphragm between said electrodes, said diaphragm having a hole in line with said stream of electrolytic fluid;

providing a chamber into which said stream of electrolytic fluid is directed, said chamber having at least one opening in an upper portion; and collecting fluid from a lower portion of said chamber.

19. An apparatus for separating charged ions and particles from an electrolytic fluid, comprising:

an upper annular magnet;

a lower annular magnet spaced apart from said upper annular magnet, forming a space between said magnets and a cavity at the center of said magnets;

a substantially nonconductive ion separation chamber enclosing said magnets, substantially coextensive with the outer surfaces of said magnets;

an inlet electrode extending into said cavity and having a hollow passage through which the electrolytic fluid enters said ion separation chamber;

an oppositely-charged second electrode between said magnets and adjacent said upper magnet, said second electrode having substantially the same diameter as said upper magnet and an opening located substantially at its center;

at least one upper outlet tube connected to said ion separation chamber at a location where fluid may be drawn from said space between said magnets;

at least one lower outlet tube connected to said ion separation chamber adjacent said inlet electrode; and a waste tube connected to said opening in said second electrode.

20. The apparatus of claim 19, further comprising at least one additional magnet connected in series with said lower magnet.

21. The apparatus of claim 20, wherein said lower electrode extends into the ion separation chamber a distance less than the thickness of the lowest magnet in said ion separation chamber.

22. The apparatus of claim 19, wherein said lower magnet is thicker than said upper magnet.

23. An apparatus for separating charged ions and particles from an electrolytic fluid in which the apparatus is immersed, comprising:

a plurality of annular magnets spaced apart from one another;

a lower seal closing the center opening in the lowermost magnet;

a plurality of electrodes spaced substantially evenly around the outer perimeters of and connected to said plurality of magnets;

an outlet hose in fluid communication with the space at the center of said plurality of annular magnets; and an upper seal surrounding said outlet hose and closing the center opening in the uppermost magnet.

24. The apparatus of claim 23, wherein said electrodes are substantially rod-shaped and are oriented substantially vertically.

25. The apparatus of claim 23, wherein an even number of electrodes are provided, and each electrode has a polarity opposite to both neighboring electrodes.

26. The apparatus of claim 23, wherein a portion of each electrode facing away from said magnets is electrically active, and the remainder of each electrode is electrically insulated.

* * * * *